US007479042B2

(12) United States Patent
Chen

(10) Patent No.: US 7,479,042 B2
(45) Date of Patent: Jan. 20, 2009

(54) USB CONNECTOR TYPE MEMORY CARD ADAPTER

(75) Inventor: I-Ming Chen, Taipei (TW)

(73) Assignee: Singim International Corp., Taipei Hsien (TW)

( * ) Notice: Subject to any disclaimer, the term of this patent is extended or adjusted under 35 U.S.C. 154(b) by 0 days.

(21) Appl. No.: 11/846,515

(22) Filed: Aug. 28, 2007

(65) Prior Publication Data

US 2008/0096413 A1 Apr. 24, 2008

(30) Foreign Application Priority Data

Oct. 24, 2006 (TW) ..... 95218795 U

(51) Int. Cl.
*H01R 24/00* (2006.01)
*H01R 33/00* (2006.01)

(52) U.S. Cl. ..... 439/660; 439/945

(58) Field of Classification Search ..... 439/630, 439/660, 638, 607, 945, 374; 361/686
See application file for complete search history.

(56) References Cited

U.S. PATENT DOCUMENTS 6,560,097 B2 * 5/2003 Naruo et al. ..... 361/685

* cited by examiner

*Primary Examiner*—Javaid Nasri

(57) ABSTRACT

A USB connector type memory card adapter is disclosed to include a metal shield covered with a cover shell having a memory card insertion hole and insertable into a USB jack of an electronic apparatus, a USB connector unit mounted inside the metal shield and electrically connectable to the USB jack into which the metal shield is inserted, and a memory card module longitudinally connected to the rear end of the USB connector unit in a flush manner inside the metal shield and electrically connected to the USB connector unit for receiving the inserted memory card and electrically connecting the inserted memory card to the USB connector unit.

11 Claims, 8 Drawing Sheets

USB CONNECTOR TYPE MEMORY CARD ADAPTER

This application claims the priority benefit of Taiwan patent application number 095218795 filed on Oct. 24, 2006.

BACKGROUND OF THE INVENTION

1. Field of the Invention

The present invention relates to a memory card adapter and more particularly, to a USB connector type memory card adapter, which is made in the form of a USB plug insertable into a USB jack of an electronic apparatus to electrically connect a memory card to the electronic apparatus.

2. Description of the Related Art

Following fast development of computer technology, innovative consumer electronic products are continuously created and digitalized. Modern digital electronic products, such as digital TVs, digital audio systems, MP3 players, digital cameras, electronic dictionaries, digital video cameras, PDAs and etc. commonly use a memory card for storing data and a memory card reader for reading storage data from the memory card. Further, following the market trend toward light, thin, short and small characteristics, the internal parts of an electronic product must be made relatively smaller to save the space. Therefore, mini memory cards are developed.

Commercial memory cards are numerous, including MMC (MultiMedia Card), CF (CompactFlash card), SMC (Smart Media Card), MS (MemoryStick), SD (Secure Digital Memory Card) etc. There are also small-sized, high-capacity memory cards available on the market, such as Mini SD, MS Duo, Trans Flash etc.

The storage data of a memory card is readable by a memory card reader. A memory card reader can also stores the fetched data from a memory card in a computer. Because memory card standards are numerous, universal memory card readers are developed to read different kinds of memory cards. However, regular universal memory card readers can only receive relatively bigger size memory cards such as SD (Secure Digital Memory Card) or the like, not allow for the insertion of a mini memory card such as Trans Flash or the like. For reading a mini memory card, an adapter cable must be used. It is complicated to use an extra adapter cable with a memory card reader. The use of an extra adapter cable relatively needs an extra cost.

Further, a memory card reader is an interface between a memory card and a computer. By means of hot plug, a memory card reader is connectable to a USB port at a computer for enabling the computer to read in storage data rapidly from a memory card that is inserted into the memory card reader. Commercial memory card readers commonly have a big size, not designed for insertion into a computer's USB port directly. For connecting a commercial memory card reader to a computer's USB port, an extra USB cable must be used. When many external peripheral apparatus are connected to a computer, the arrangement of the peripheral apparatus cables may bother the user.

Therefore, it is desirable to provide a light, thin, short and small memory card adapter that eliminates the aforesaid drawbacks.

SUMMARY OF THE INVENTION

The present invention has been accomplished under the circumstances in view. According to one aspect of the present invention, the USB connector type memory card adapter comprises a hollow metal shield insertable into a USB jack of an electronic apparatus, the hollow metal shield comprising two locating slots symmetrically disposed at two opposite sides thereof and a top opening; a cover shell fastened to the top opening of the hollow metal shield, the cover shell having an insertion hole for the insertion of a memory card; a USB connector unit mounted inside the hollow metal shield and electrically connectable to the USB jack into which the hollow metal shield is inserted; and a memory card module fixedly connected to one end of the USB connector unit inside the hollow metal shield and electrically connected to the USB connector unit for receiving a memory card inserted into the insertion slot and electrically connecting the inserted memory card to the USB connector unit.

According to another aspect of the present invention, the aid memory card module comprises a plurality of conducting terminals for forward contact with the inserted memory card to electrically connect the inserted memory card to the USB connector unit.

According to still another aspect of the present invention, the conducting terminals each comprise a downwardly curved press portion pressed on the memory card module, a contact portion for the contact of the inserted memory card, and a spring arm portion connected between the downwardly curved press portion and the contact portion and suspending above the memory card module.

DETAILED DESCRIPTION OF THE PREFERRED EMBODIMENT

Figure 1:
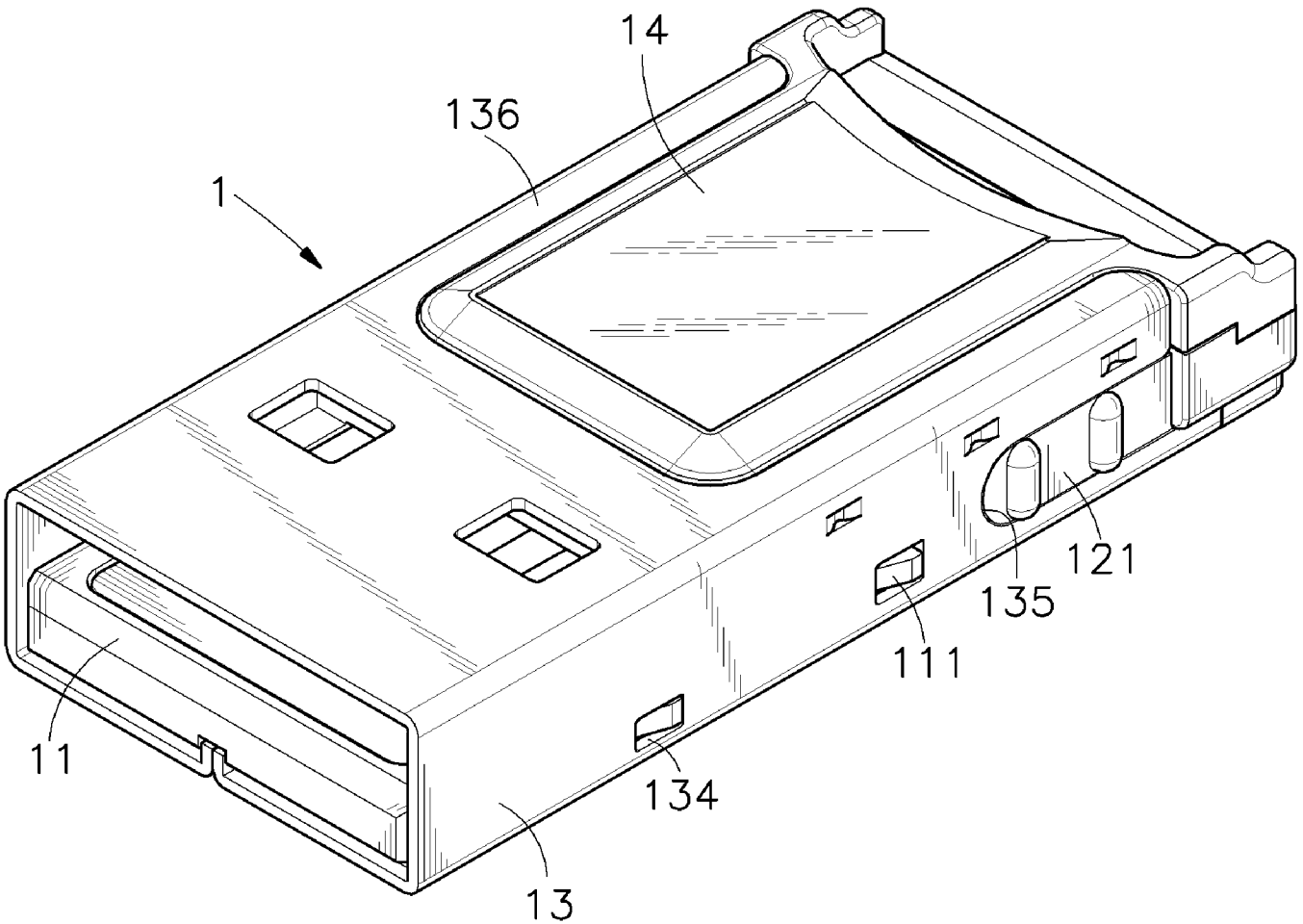
FIG. 1 is an elevational view of a USB connector type memory card adapter in accordance with the present invention.
Figure 2:
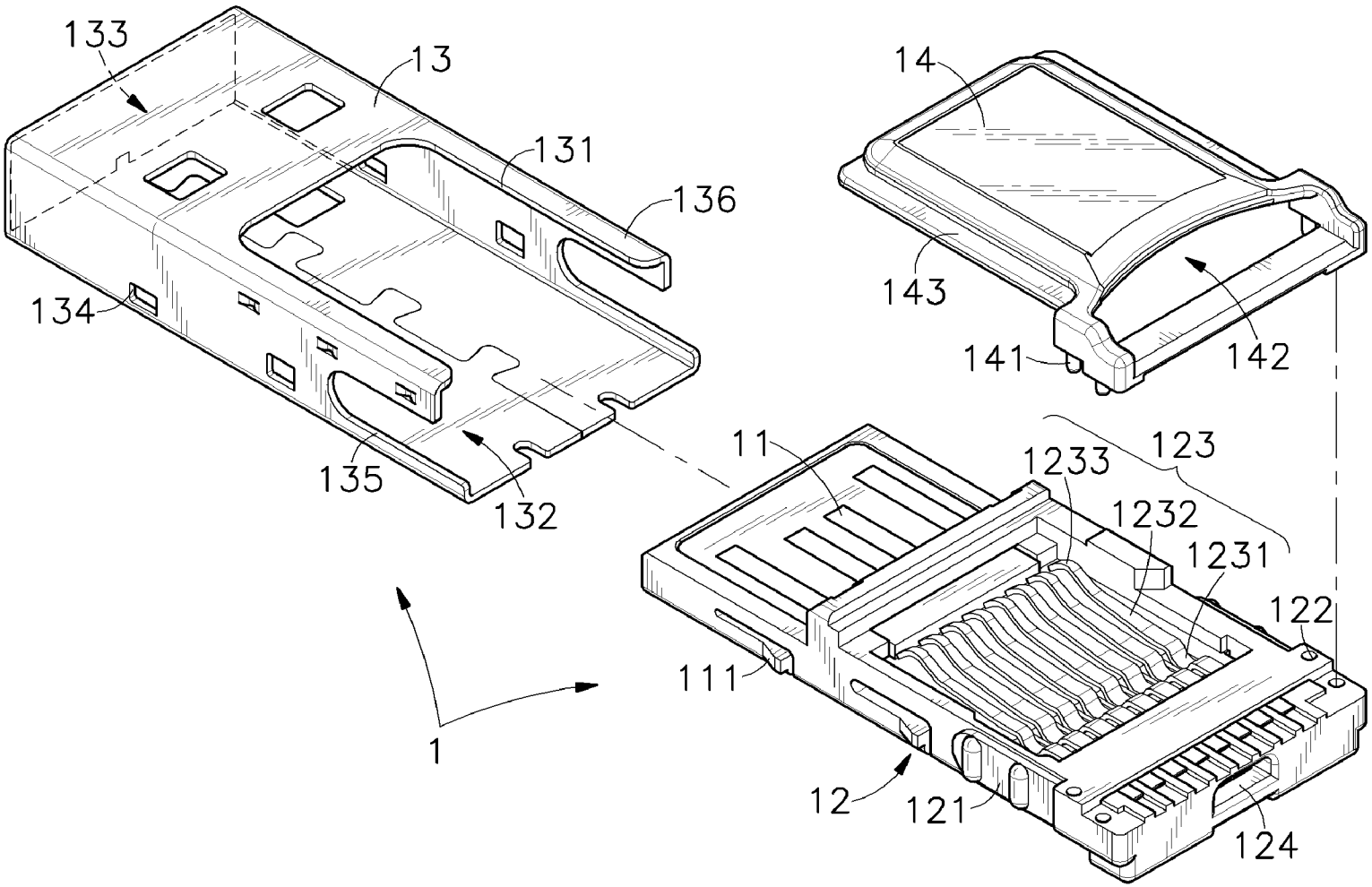
FIG. 2 is an exploded view of the USB connector type memory card adapter according to the present invention.
Figure 3:
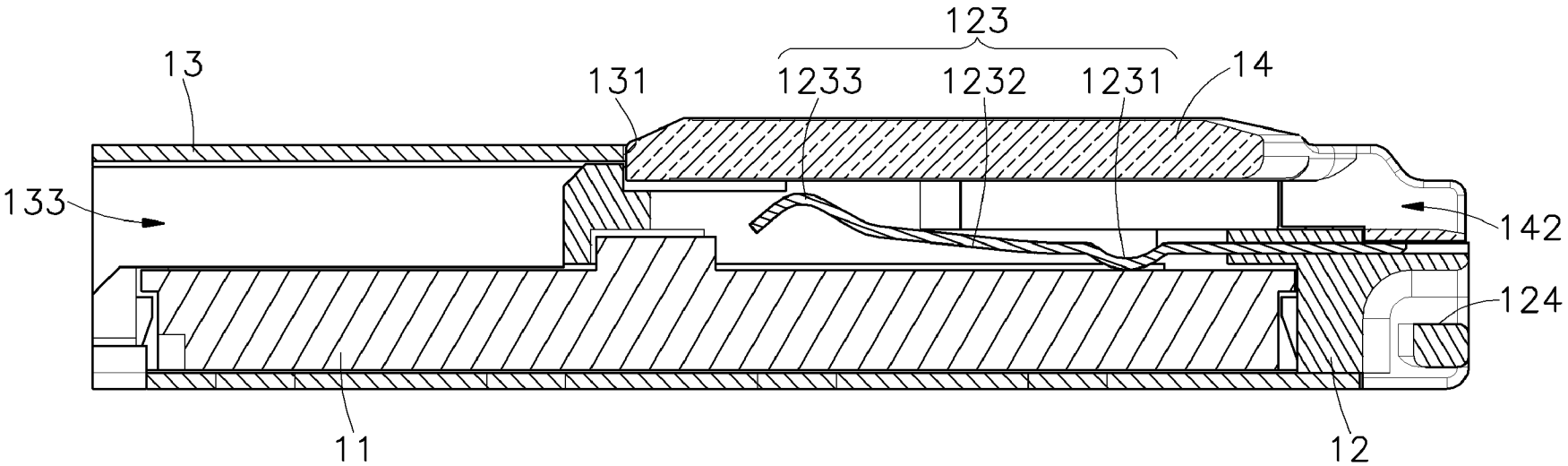
FIG. 3 is a sectional side view of the USB connector type memory card adapter according to the present invention.

Referring to FIGS. 1~3, a USB connector type memory card adapter 1 in accordance with the present invention is shown comprising a USB connector unit 11, a memory card module 12 formed integral with one end of the USB connector unit 11 and electrically connected to the USB connector unit 11, a metal shield 13 surrounding the USB connector unit 11 and the memory card module 12, and a cover shell 14 fitted into a top opening 131 of the metal shield 13 over the top side of the memory card module 12.

Figure 4:
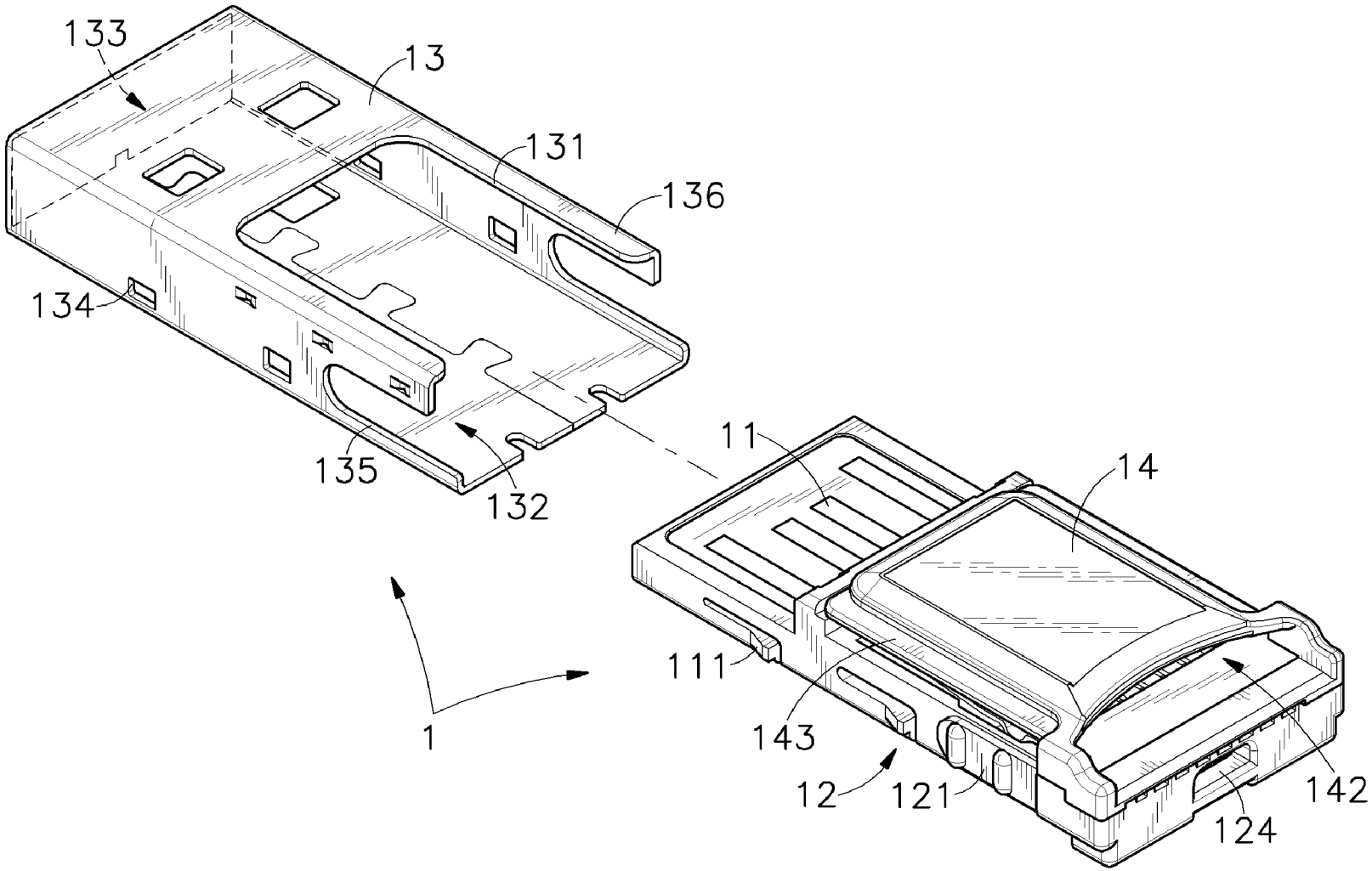
FIG. 4 is another exploded view of the USB connector type memory card adapter according to the present invention.
Figure 5:
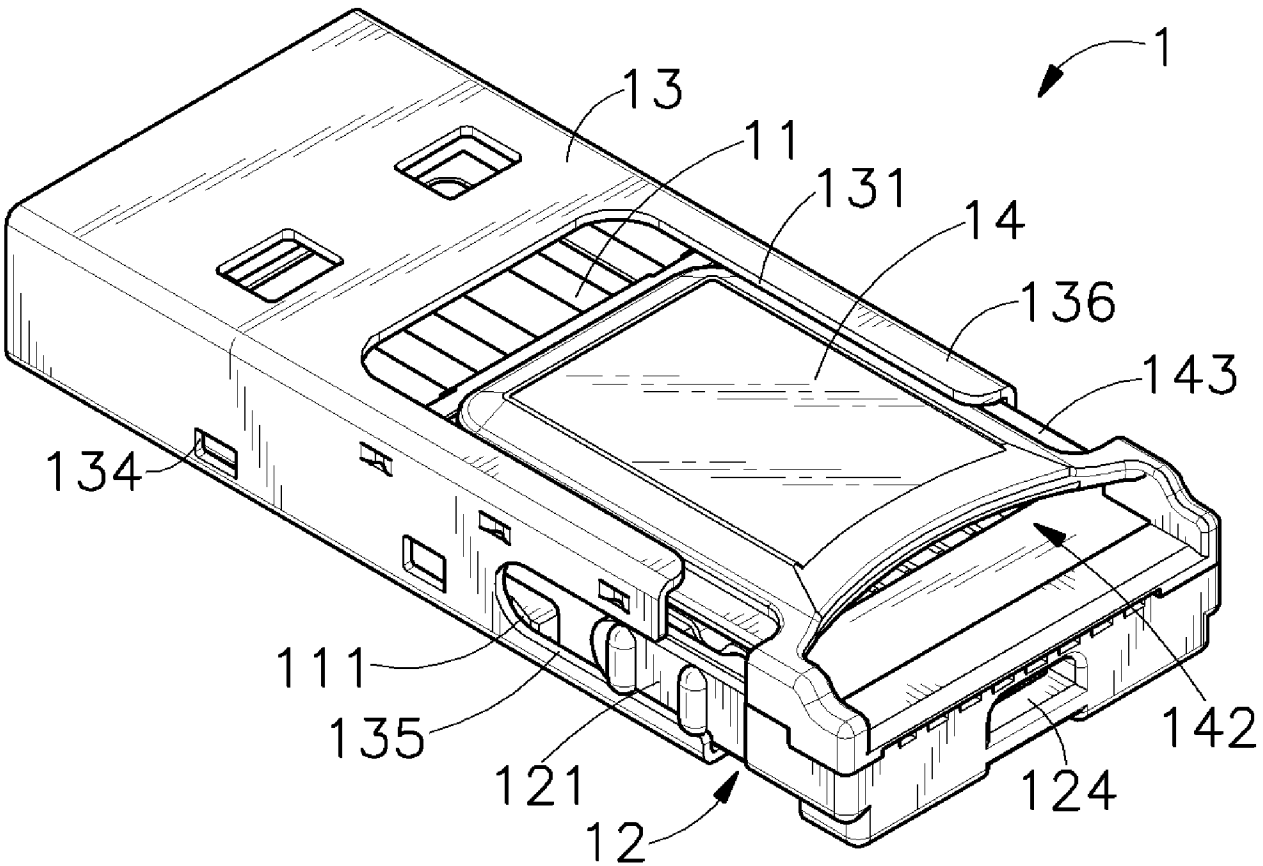
FIG. 5 is a cutaway view of the USB connector type memory card adapter according to the present invention.

Referring to FIGS. 4 and 5 and FIGS. 2 and 3 again, the metal shield 13 is shaped like a rectangular tube for insertion into a USB jack, having the aforesaid top opening 131, a rear opening 132, a front opening 133, a plurality of retaining holes 134 symmetrically disposed at the two opposite lateral side walls near the front side, two locating slots 135 respectively formed on the two opposite lateral sidewalls and longitudinally extending to the rear side, and two sliding tracks 136 longitudinally arranged in parallel at two sides of the top opening 131. The USB connector unit 11 comprises a plurality of springy hooks 111 symmetrically disposed at two opposite sides for engaging the retaining holes 134 of the metal shield 13. The memory card module 12 comprises two locating portions 121 symmetrically disposed at two opposite lateral sides for positioning in the locating slots 135 of the metal shield 13, a plurality of top mounting holes 122 for the mounting of the cover shell 14, a set of conducting terminals 123 fixedly mounted in the top side and electrically connected to the USB connector unit 11, and a hanging hole 124 on the free end (the end remote from the USB connector unit 11) for the mounting of a hanging cord. The cover shell 14 has a plurality of bottom mounting rods 141 corresponding to the top mounting holes 122 of the memory card module 12, an insertion hole 142 through which a memory card 2 is inserted into the memory card module 12 (see FIG. 6), and two sliding rails 143 longitudinally arranged in parallel at two opposite lateral sides corresponding to the sliding tracks 136 of the metal shield 13.

Referring to FIGS. 2~5 again, the cover shell 14 is fastened to the top side of the memory card module 12 by fitting the bottom mounting rods 141 of the cover shell 14 into the respective top mounting holes 122 at the memory card module 12. After installation of the cover shell 14 in the memory card module 12, the memory card module 12 and the cover shell 14 are inserted with the USB connector unit 11 through the rear opening 132 into the inside of the metal shield 13 to move the sliding rails 143 of the cover shell 14 along the sliding tracks 136 of the metal shield 13 and to force the springy hooks 111 of the USB connector unit 11 into the retaining holes 134 of the metal shield 13 and the locating portions 121 of the memory card module 12 into the locating slots 135 of the metal shield 13 respectively.

Figure 6:
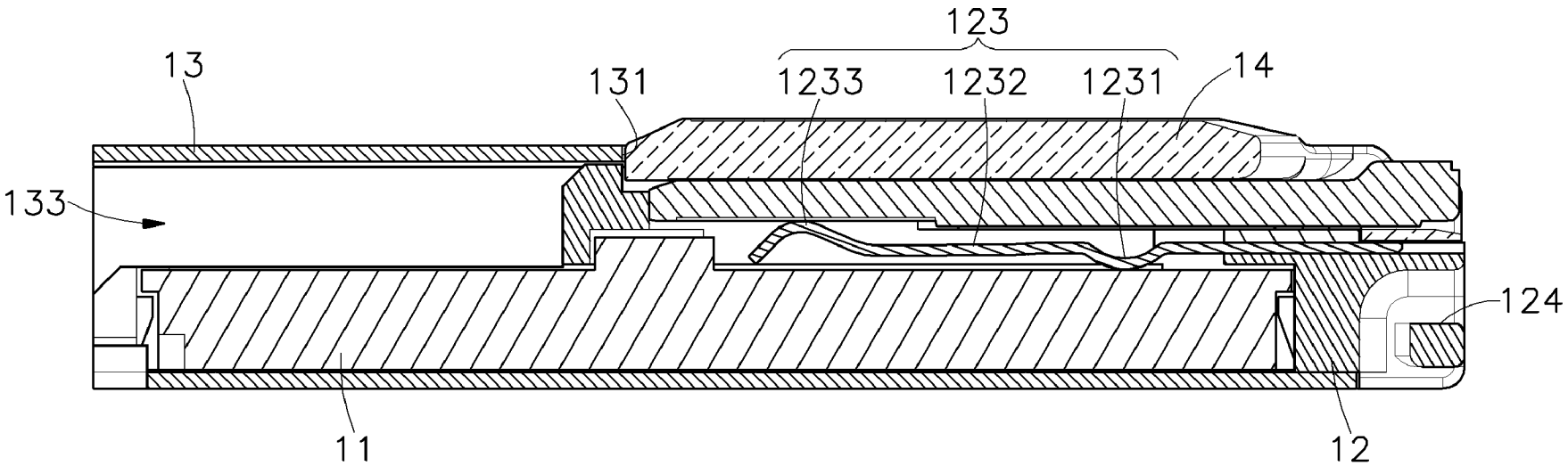
FIG. 6 is a sectional side view of the present invention after insertion of a memory card into the USB connector type memory card adapter.
Figure 7:
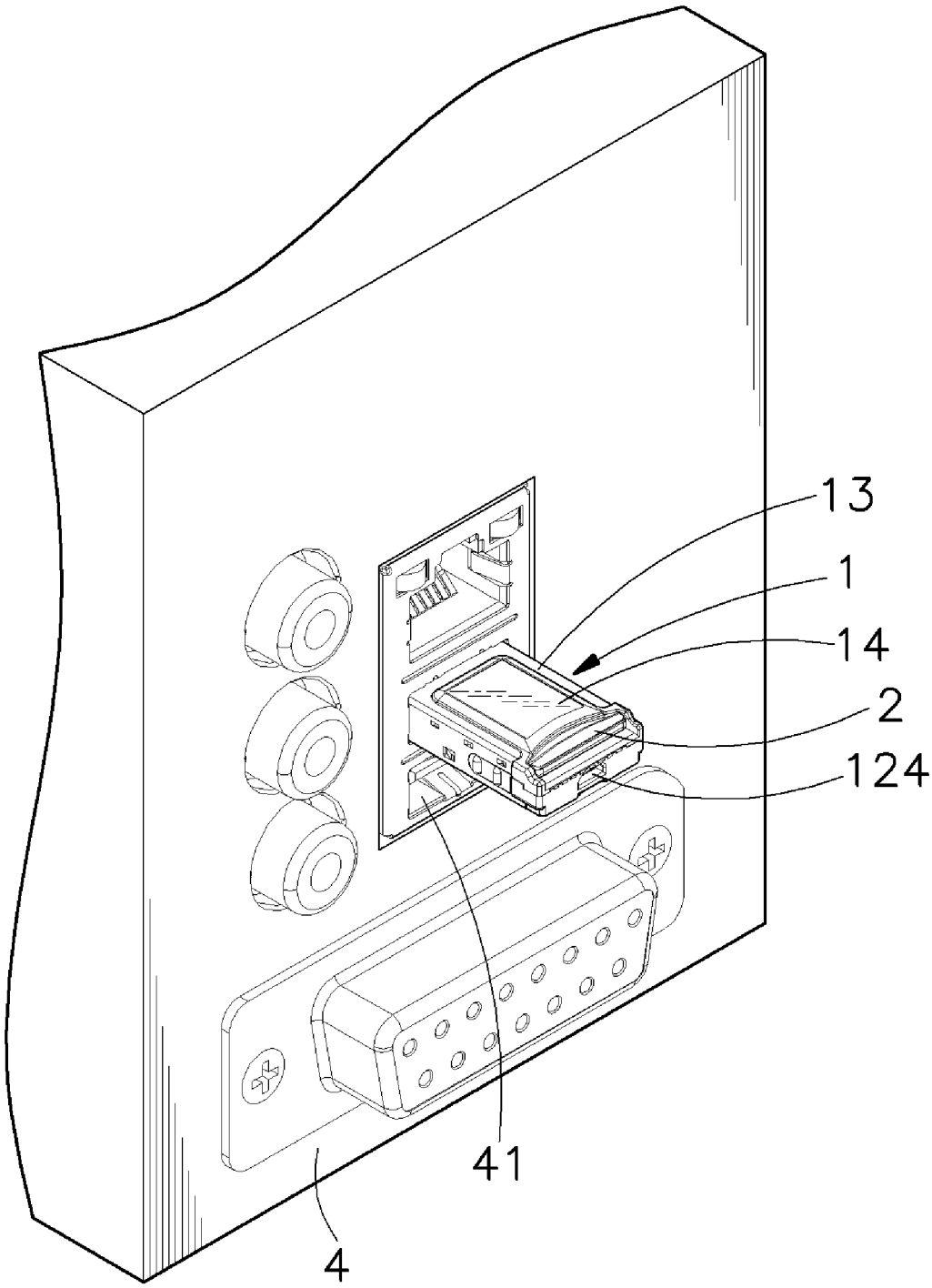
FIG. 7 is an applied view of the present invention, showing the USB connector type memory card adapter inserted into a USB jack in an electronic apparatus.

Referring to FIGS. 6 and 7 and FIG. 2 again, after insertion of a memory card 2 through the insertion hole 142 of the cover shell 14 into the memory card module 12 of the USB connector type memory card adapter 1 into contact with the conducting terminals 123, the USB connector unit 11 of the USB connector type memory card adapter 1 is inserted into a USB jack 41 of an electronic apparatus 4 to electrically connect the memory card 2 to the electronic apparatus 4, enabling the electronic apparatus to access the memory card 2.

Referring to FIGS. 2, 3 and 6 again, each conducting terminal 123 has one end fixedly fastened to the memory card module 12, and the other end suspending above the top wall of the memory card module 12 and terminating in a downwardly curved press portion 1231, an obliquely upwardly extending spring arm portion 1232 and then a contact portion 1233. The downwardly curved press portion 1231 is pressed on a respective electric contact (not shown) in the top wall of the memory card module 12 to support the spring arm portion 1232 and the contact portion 1233 above the top wall of the memory card module 12. After insertion of the memory card 2 into the memory card module 12, the spring arm portion 1232 imparts a pressure to the contact portion 1233, forcing the contact portion 1233 into forward contact with the respective contact in the bottom side of the memory card 2. At this time, the memory card 2 gives a downward pressure to the contact portion 1233 and the spring arm portion 1232, forcing the downwardly curved press portion 1231 is positive contact with the respective electric contact in the top wall of the memory card module 12. Therefore, signal is transmitted from the memory card 2 through the conducting terminals 123 and the USB connector unit 11 to the electronic apparatus 4 positively. The design of the conducting terminals 123 eliminates the problems of elastic fatigue and contact error.

According to the aforesaid design, the metal shield 13 is shaped like a rectangular tube insertable into the USB jack 41 of the electronic apparatus 4. The metal shield 13 has a uniform internal width from the front opening 133 to the rear opening 132 (see FIG. 2). The USB connector unit 11 and the memory card module 12 have a uniform width fitting the internal width of the metal shield 13. Therefore, the size of the USB connector type memory card adapter 1 is minimized.

Figure 8:
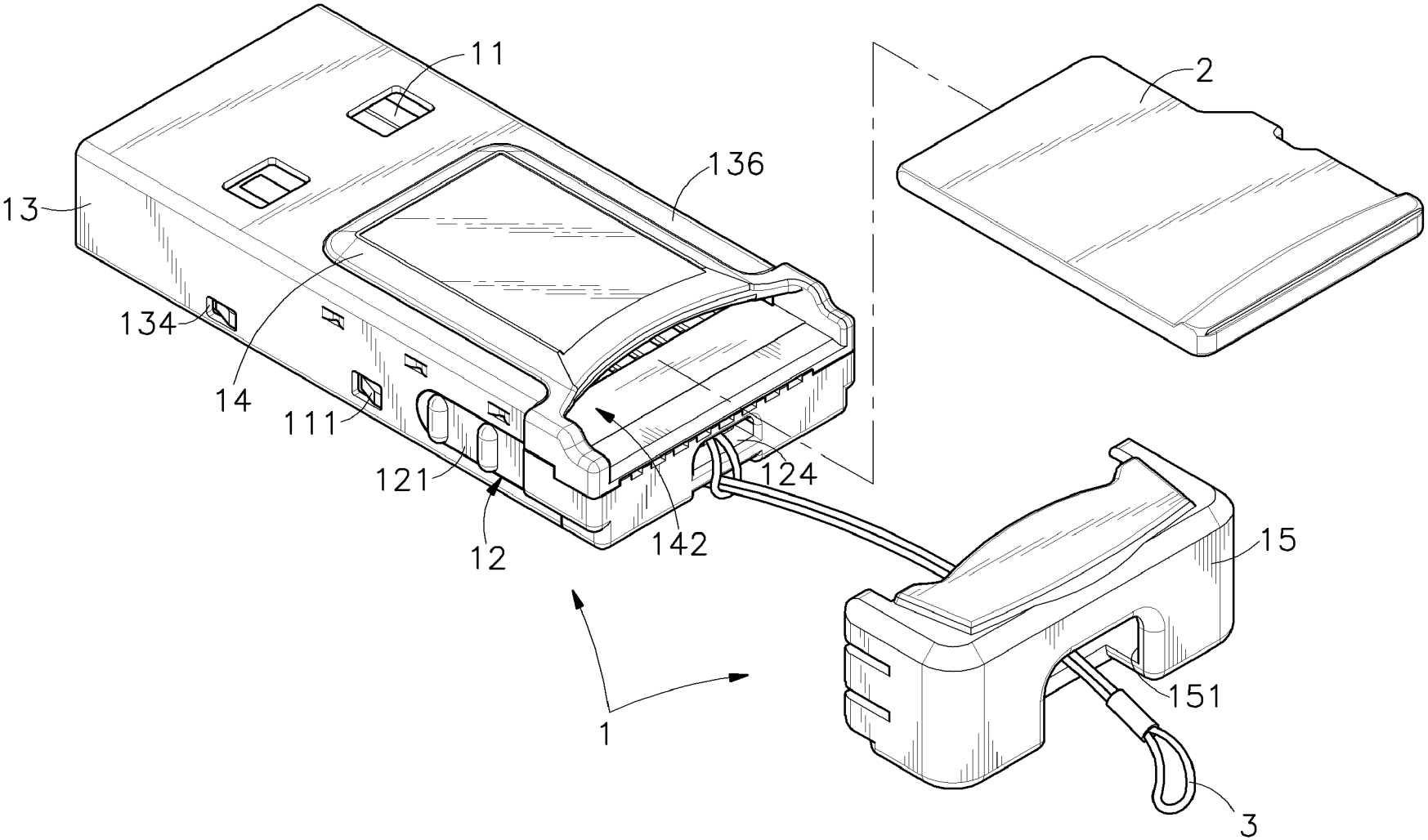
FIG. 8 is an exploded view of an alternate form of the USB connector type memory card adapter according to the present invention.

FIG. 8 illustrates an alternate form of the USB connector type memory card adapter according to the present invention. According to this design, an end cap 15 is capped on the cover shell 14 to block the insertion hole 142 against dust and external object. When wishing to insert a memory card 2 into the memory card module 12, remove the end cap 15 from the cover shell 14, and then insert the memory card 2 through the insertion hole 142 into the inside of the memory card module 12. The cover shell 14 can be transparent so that the user can see the type of the inserted memory card 2. Further, the end cap 15 has a through hole 151 corresponding to the hanging hole 124 for the passing of a hanging cord 3 that is fastened to the hanging hole 124.

Further, the aforesaid memory card 2 is a mini memory card, such as, Mini SD, MS Duo or Trans Flash.

As indicated above, the invention provides a USB connector type memory card adapter, which has the following features:

1. The conducting terminals 123 are formed in the memory card module 12 in integrity, each having a contact portion 1233 for forward contact with the inserted memory card. Therefore, when a memory card is inserted into the USB connector type memory card adapter 1, the inserted memory card is kept in positive contact with the conducting terminals 123. When the memory card is removed from the USB connector type memory card adapter 1, the conducting terminals 123 immediately return to their former shape.

2. The USB connector unit 11 and the memory card module 12 are longitudinally connected in a line in a flush manner and fitted into the metal shield 13. The cover shell 14 is fastened to the memory card module 12 at the top, having two sliding rails 143 symmetrically disposed at two opposite lateral sides and respectively coupled to the sliding tracks 136 of the metal shield 13, guiding the USB connector unit 11 and the memory card module 12 into the metal shield 13. Therefore, the whole assembly is small sized.

3. The memory card module 12 has a hanging hole 124 for the mounting of a hanging cord 3, and an end cap 5 is capped on the rear end of the USB connector type memory card adapter 1 to protect the inserted memory card. The end cap 5 has a through hole 151 for the passing of the hanging cord 3.

4. The conducting terminals 123 each comprise a downwardly curved press portion 1231 pressed on a respective electric contact at the top side of the memory card module 12, a contact portion 1233 for forward contact with the inserted memory card, and a spring arm portion 1232 connected between the downwardly curved press portion 1231 and the contact portion 1233 and suspending above the memory card connector unit 12 to support the contact portion 1233. When the contact portion 1233 contacts the inserted memory card, the spring arm portion 1232 is forced by the pressure of the memory card to force the downwardly curved press portion 1231 downwards, keeping the downwardly curved press portion 1231 in positive contact with the associating electric contact at the top side of the memory card module 12.

A prototype of USB connector type memory card adapter has been constructed with the features of FIGS. 1~8. The USB connector type memory card adapter functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A USB connector type memory card adapter comprising:

a hollow metal shield insertable into a USB jack of an electronic apparatus, said hollow metal shield comprising two locating slots symmetrically disposed at two opposite sides thereof and a top opening, wherein said hollow metal shield comprises two sliding tracks longitudinally disposed at two sides of said top opening;

a cover shell fastened to the top opening of said hollow metal shield, said cover shell having an insertion hole for insertion of a memory card, wherein said cover shell comprises two sliding rails longitudinally disposed at two opposite lateral sides thereof and respectively coupled to said sliding tracks of said hollow metal shield;

a USB connector unit mounted inside said hollow metal shield and electrically connectable to the USB jack into which said hollow metal shield is inserted; and a memory card module fixedly connected to one end of said USB connector unit inside said hollow metal shield and electrically connected to said USB connector unit for receiving a memory card inserted into said insertion hole and electrically connecting the inserted memory card to said USB connector unit.

2. The USB connector type memory card adapter as claimed in claim 1, wherein said USB connector unit and said memory card module have a same width.

3. The USB connector type memory card adapter as claimed in claim 1, wherein said memory card module comprises a plurality of conducting terminals for forward contact with the inserted memory card to electrically connect the inserted memory card to said USB connector unit.

4. The USB connector type memory card adapter as claimed in claim 3, wherein said conducting terminals each comprise a downwardly curved press portion pressed on said memory card module, a contact portion for the contact of the inserted memory card, and a spring arm portion connected between said downwardly curved press portion and said contact portion and suspending above said memory card module.

5. The USB connector type memory card adapter as claimed in claim 1, wherein said memory card module comprises a plurality of top mounting holes; said cover shell comprises a plurality of bottom mounting rods respectively fitted into said top mounting holes of said memory card module.

6. A USB connector type memory card adapter comprising a USB connector unit electrically connectable to a USB jack of an electronic apparatus, a memory card module fixedly connected to one end of said USB connector unit for receiving a memory card and electrically connecting the memory card to said USB connector unit, said USB connector unit and said memory card module being longitudinally aligned in a line and having a same uniform width, and a metal shield surrounding said USB connector unit and said memory card module, said metal shield having two sliding tracks longitudinally arranged in parallel at two sides and respectively pressed on two opposite lateral sides of said memory card module, wherein said metal shield comprises two locating slots symmetrically disposed at two opposite sides thereof; said memory card module comprises two locating portions respectively engaged in said locating slots of said metal shield.

7. The USB connector type memory card adapter as claimed in claim 6, wherein said memory card module comprises a plurality of conducting terminals for forward contact with the inserted memory card to electrically connect the inserted memory card to said USB connector unit.

8. The USB connector type memory card adapter as claimed in claim 7, wherein said conducting terminals each comprise a downwardly curved press portion pressed on said memory card module, a contact portion for the contact of the inserted memory card, and a spring arm portion connected between said downwardly curved press portion and said contact portion and suspending above said memory card module.

9. The USB connector type memory card adapter as claimed in claim 6, wherein said metal shield comprises a top opening between said two sliding tracks, and a cover shell covering said top opening, said cover shell comprising two sliding rails respectively coupled to said sliding tracks.

10. The USB connector type memory card adapter as claimed in claim 9, wherein said memory card module comprises a plurality of top mounting holes; said cover shell comprises a plurality of bottom mounting rods respectively fitted into said top mounting holes of said memory card module.

11. The USB connector type memory card adapter as claimed in claim 9, wherein said cover shell has an insertion hole for the insertion of a memory card into said memory card module.

* * * * *